United States Patent [19]

Meyers

[11] 4,289,239

[45] Sep. 15, 1981

[54] CARTON HAVING NOVEL END PANEL CONSTRUCTION

[75] Inventor: George L. Meyers, Menasha, Wis.

[73] Assignee: American Can Company, Greenwich, Conn.

[21] Appl. No.: 110,835

[22] Filed: Jan. 10, 1980

Related U.S. Application Data

[62] Division of Ser. No. 884,193, Mar. 7, 1978, Pat. No. 4,203,355.

[51] Int. Cl.[3] ..... B65D 5/18; B65D 5/28; B65D 5/54; B65D 5/66

[52] U.S. Cl. ..... 206/625; 206/624

[58] Field of Search ..... 206/624, 625, 626; 229/446 B

[56] References Cited

U.S. PATENT DOCUMENTS

| | | | |
|---|---|---|---|
| Re. 26,185 | 4/1967 | Henry | 206/626 |
| Re. 26,471 | 10/1968 | Meyers | 206/624 |
| 1,998,717 | 4/1935 | Guyer | 206/624 |
| 2,963,214 | 12/1960 | Leone et al. | 229/446 B |
| 3,197,114 | 7/1965 | Holmes | 206/624 X |
| 3,283,991 | 11/1966 | Hughes | 206/625 |
| 3,410,476 | 11/1968 | Buttery | 206/624 X |

FOREIGN PATENT DOCUMENTS

| | | | |
|---|---|---|---|
| 794700 | 9/1968 | Canada | 206/624 |

*Primary Examiner*—Stephen P. Garbe

*Attorney, Agent, or Firm*—Robert P. Auber; Harry W. Hargis, III; Ira S. Dorman

[57] ABSTRACT

A fully assembled carton has a novel end panel construction. End flaps extend from at least one of the bottom, front and rear wall panels. Closure flaps on opposed edges of the top closure panel extend downwardly over portions of the end flaps and terminate at free edges. Closure flap extensions abut the free edges of the closure flap, extend downwardly therefrom over additional portions of the end flaps, and are affixed to adjacent portions of the end flaps.

7 Claims, 9 Drawing Figures

CARTON HAVING NOVEL END PANEL CONSTRUCTION

This is a division of application Ser. No. 884,193, filed Mar. 7, 1978, now U.S. Pat. No. 4,203,355.

BACKGROUND OF THE INVENTION

The present invention is directed to improvements in packaging structure and apparatus useful in its assembly. While of broader applicability, the invention is particularly useful in the assembly of top-opening cartons of the so-called flip-top type.

In the assembly of packaging structure, such as top-opening cartons, it has been found difficult to form side or end flaps thereof economically while providing a carton that is easily opened along a line of weakness. In top-opening cartons of the flip-top type, a closure or cover is provided in the form of a panel hinged to the carton body along a fold line. The remaining three sides of the closure have flaps that overlap adjacent carton wall panels, and at least the opposed flaps are sealed thereto by flap extensions provided with lines of weakness. Contents of the carton are accessible by lifting the closure about its hinged connection while tearing the flap extensions along corresponding lines of weakness. The lines of weakness, of course, must be readily tearable in order that the carton not be so damaged as to prevent its reclosure.

It is a general objective of this invention to provide improved carton structure of the aforementioned type, and apparatus facilitating its assembly.

SUMMARY OF THE INVENTION

In achievement of the foregoing as well as other objectives, the invention contemplates carton structure, preferably of generally rectangular configuration, provided with a top closure panel hinged along one edge thereof and a tearable flap on at least opposed ones of the other edge portions sealed to the carton body. Means affording tearing of flaps on the opposed ones of the edge portions are partially cut or torn in the assembly thereof to facilitate opening of the carton. The invention further contemplates apparatus useful in the assembly of such a carton and comprising means for moving a partially assembled carton along a travel path, said carton having open end closure flaps extending in a direction transverse to the travel path, cutting edge means disposed adjacent the travel path, and means for folding the end closure flaps and sealing end portions thereof, as the carton is moved along the travel path, the cutting edge means thereupon being effective to sever the flaps from their sealed portions.

The manner in which the foregoing as well as other objectives and advantages of the invention may best be achieved will be more fully understood from a consideration of the following description, taken in light of the accompanying drawings.

DETAILED DESCRIPTION OF THE INVENTION

Figure 1:
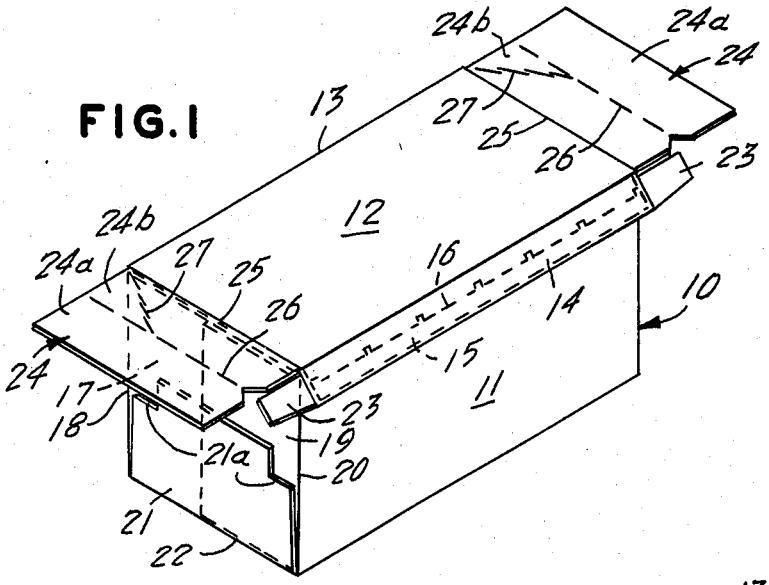
FIG. 1 is a perspective view of a partially assembled carton embodying the invention.

With more detailed reference to FIG. 1, a filled, generally rectangular carton 10 of the flip-top type, and fabricated of a resilient material such as, for example, paperboard, is shown in partially assembled mode and comprises a front wall panel 11, a corresponding rear wall panel (not shown), a bottom wall panel (not shown), and a top wall panel 12 serving as a carton closure and hinged along a fold line 13 on one edge thereof to the rear wall panel. Top wall panel 12 includes side flap 14 on a free edge disposed opposite fold line 13. Flap 14 is glued, or otherwise conveniently adhered, to a downturned flap 15 provided on an upper edge of front wall panel 11 and including a weakness line 16. With reference still to FIG. 1, each vertical edge of the rear wall panel of carton 10 includes a fold line 18 about which end flap 17 is folded to extend over part of the corresponding carton end, and each vertical edge of the front wall panel 11 of the carton includes an end flap 19 folded about a fold line 20 to extend over flap 17. An end flap 21 on a horizontal edge of the bottom wall panel is folded upwardly about a fold line 22 onto the overlapping flaps 17, 19 which end flap 21 includes notched corners **21*a*. It will be appreciated, therefore, that the structure of the non-visible, far end of carton 10** is identical with the visible, near end.

Figure 2:
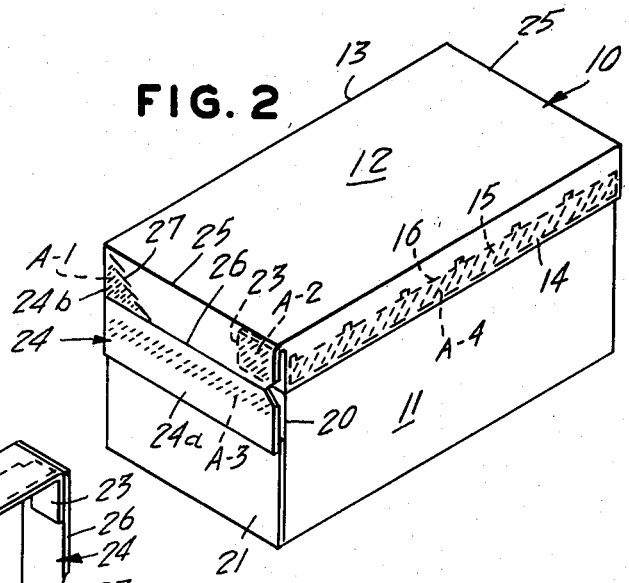
FIG. 2 is a perspective view of a fully assembled carton embodying the invention.

In especial accordance with the invention, flap 14 of top wall panel 12 includes a pair of end tabs 23 foldable about vertically extending fold lines, at right angles onto end flaps 19; and a pair of end closure flaps 24 on panel 12 are foldable along horizontally extending fold lines 25 onto ends of the carton, to positions seen in FIG. 2. Each end closure flap 24 includes an extension **24*a* provided with a horizontally extending first line of weakness 26. Each closure flap 24 includes a second line of weakness 27 intersecting the upper end of fold line 18 and extending with angularity to intersect horizontally extending line of weakness 26, thus defining, with a rear vertical edge of the flap and a portion of line 26, a triangular section 24*b***.

In achievement of carton sealing, glue, or other suitable adhesive, is applied in patterns as shown by stippling designated generally by reference characters A-1, A-2, A-3, and A-4 applied to FIG. 2, alone, for convenience of illustration. Of the glue patterns, A-1 adheres triangular section **24*b* to flap 17, A-2 adheres flap 24 to flap 23, A-3 adheres flap extension 24*a* to the underlying free edge region of flap 21 and portions of flaps 17, 19 in registry with notched, or otherwise relieved, portions 21*a* of flap 21**.

Figure 3:
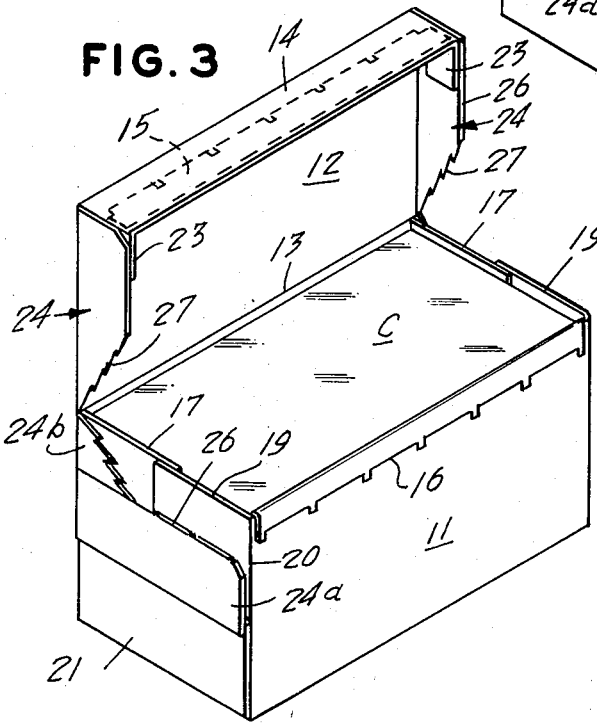
FIG. 3 is a view of the assembled carton seen in FIG. 2, in opened position.

Further to the invention, line of weakness 26 will have been severed in the showing of FIG. 2, by means contemplated by the invention, and to be described in connection with FIGS. 4 to 9. To open carton 10, and with reference also to FIG. 3, flaps 14, 15 are urged upwardly and outwardly to tear flap 15 along line of weakness 16, and closure flaps 24 along lines of weakness 27 while top wall panel 12 is pivoted about fold line 13, to the illustrated open position exposing contents C.

Advantageously, assembly of the opened carton is maintained through sealing by glue strip A-3, of the extension 24*a* on each flap 24 to the underlying free edge closure region of flap 21 and to the portions of flaps 17, 19 in registry with the notched portions 21*a* of flap 21.

Turning now to apparatus contemplated by the invention for assembling carton 10 thus far described, reference is made to FIGS. 4 to 9 of the drawings. As is seen to advantage in FIG. 4, apparatus for assembling carton 10 includes the conveyor section 30 of a form, fill, and seal machine of otherwise conventional design. Conveyor section 30 includes a horizontally extending, elongate track section 31 provided with a central longitudinal groove 32 within which rides a conveyor chain 33 driven by known means. Chain 33 includes vertically extending pusher elements, only one of which is shown at 34, placed at intervals along the chain. Each pusher element 34 is disposed and adapted abuttingly to engage the rear side wall panel (not shown) of a carton 10.

Figure 4:
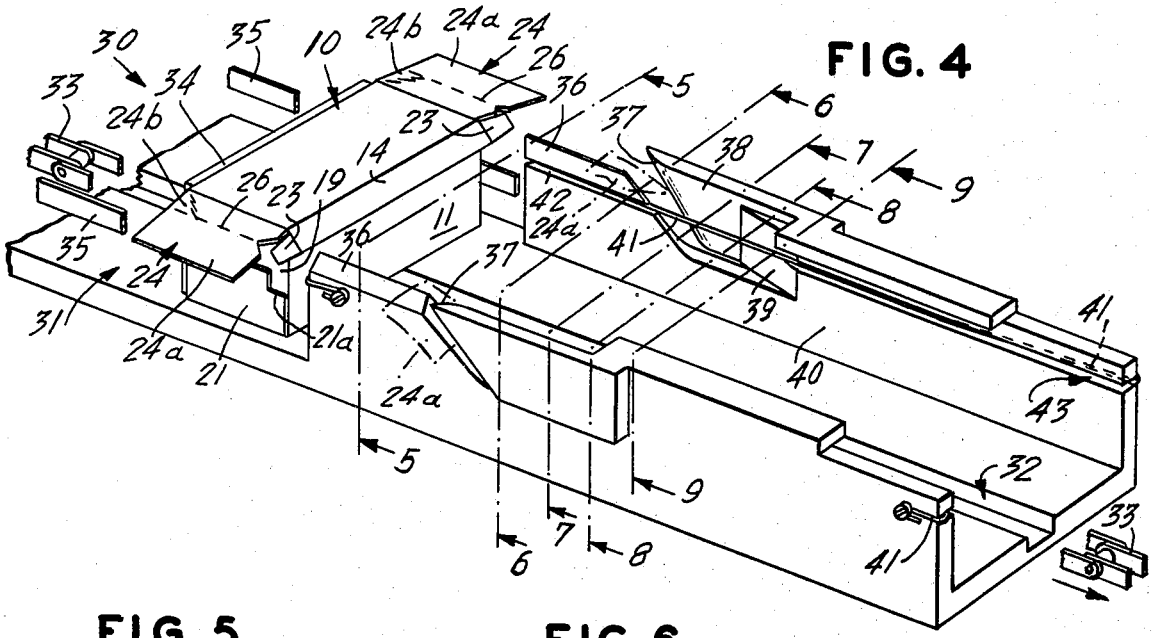
FIG. 4 is a fragmentary perspective view illustrating the partially assembled carton of FIG. 1 in combination with apparatus useful in assembling same.

The stage of assembly of carton 10 as shown in FIG. 4 corresponds to the showing of FIG. 1 in which the carton has been filled and is ready to be closed and sealed. It is also to be understood that glue has been applied closure to flap 24 by suitably positioned glue applicators of known type, in the patterns hereinabove described. With further reference to FIG. 4, a pair of opposed side rails 35 of conveyor section 30 engage upwardly folded end flaps 21 of the carton to guide it along the track as it is pushed by elements 34 from left to right. Downstream of side rails 35 are a series of oppositely paired flap plows 36, 37, 38, 39, and 40 disposed and adapted sequentially to engage and fold the flaps 23 and 24 in accordance with the sectional showings in FIGS. 5, 6, 7, 8, and 9.

Figure 5:
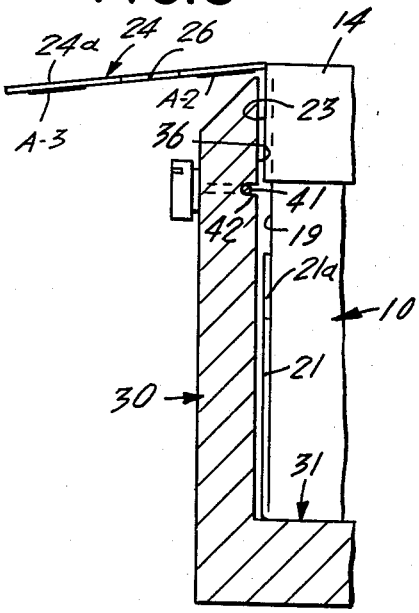
FIGS. 5 to 9 are sectional views, taken in the direction of arrows 5—5 to 9—9, respectively, applied to FIG. 4, and illustrating steps in the assembly of the carton seen in FIGS. 2 and 3.
Figure 6:
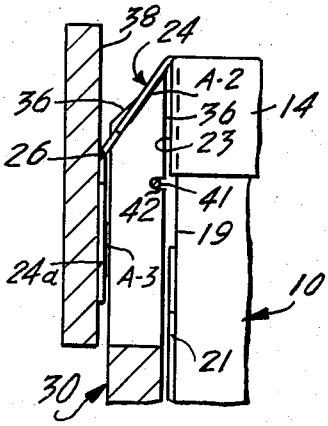
Figure 7:
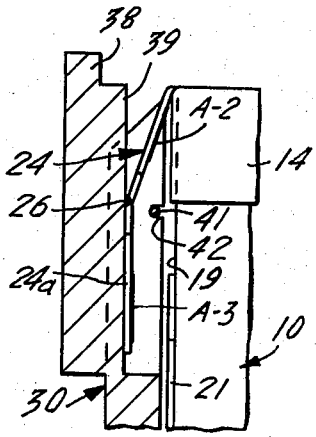

Engagement of a flap 23 by a suitably presented plow 36 is illustrated to advantage in FIG. 5, in which FIG. flaps 23 have been folded inwardly and are held against the folded end flaps 19 of the filled carton. As carton 10 continues to be moved along the conveyor, another pair of flap plows 37, 38, sequentially engage the closure flaps 24 in accordance with the broken line showing of FIG. 4 and the showing of FIG. 6. Further transfer of carton 10 along conveyor section 30 is illustrated in FIG. 7, where plow 39 further has urged closure flaps 24 toward the end flaps 19 and 23 of the carton.

Figure 8:
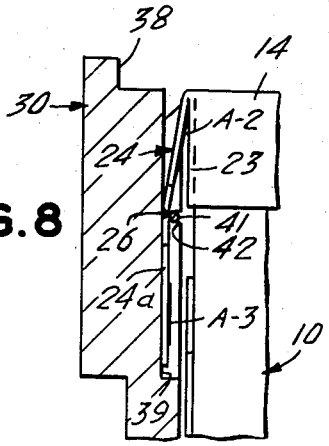
Figure 9:
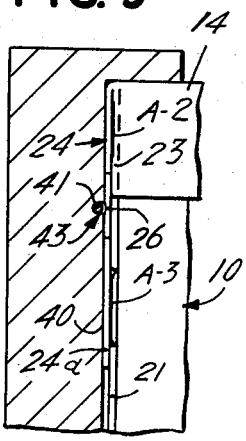

Continued movement of carton 10 is illustrated in FIG. 8, where, in especial accordance with the invention, closure flaps 24 have just been urged against means defining a pair of elongate cutting edges each comprising a wire 41, such as, for example, a single strand of tautly supported steel wire of relatively small diameter, disposed in laterally inwardly facing grooves 42, 43 provided within plows 36 and 40, respectively. Positioning of each wire 41 is such that an upstream portion thereof, as respects direction of conveyor travel, is disposed in substantially adjacent, overlying relationship as respects the end of the carton, and its downstream portion is positioned a short space, laterally outwardly, from the carton. This lateral spacing is characterized in that the wire 41 in a portion of groove 43 is disposed with angularity as respects the travel of the carton. By such angularity, and with reference to FIG. 9, each closure flap 24 with its line of weakness 26 coinciding with the line of extension of the cutting wire 41 is urged by plow 40 against the wire to the extent that the wire cuts through the aforesaid line of weakness. Urging of closure flaps 24 by plows 40 further causes the regions of applied adhesive A-1, A-2, A-3, and A-4 to engage and adhere their corresponding underlying end flap regions as described in connection with FIG. 2.

It will be appreciated that severing the horizontal line of weakness 26 further is aided by provision of a V-shaped notch 24*c* on closure flap 24 presented in the direction of conveyor travel and having its vertex at the downstream end of line 26. By such disposition, notch 24*c* is capable of compensating for slight misalignments of wire 41 with line 26, since the wire, by virtue of its inherent flexibility, may be channeled by sides of the notch into alignment with line 26.

Provision of a line of weakness 26 capable of being severed on the conveyor to leave a reinforcing, carton sealing flap portion 24*a* advantageously enhances both retention of carton assembly and ease of opening due to partial tearing of the adherent closure flap. Only line of weakness 27 then need be torn to release the closure wall panel 12 from the closure-maintaining flap portion 24*b*. It is to be understood that the invention contemplates that carton closure may be maintained solely by adherence of flap portion 24*b* to flap 17, without need for adhering flap 14 in the manner disclosed.

While preferred embodiments of the invention have been illustrated and described, it will be appreciated that modifications may be made without departing from the scope of the appended claims.

I claim:

1. A fully assembled, unopened, carton of the type provided with a bottom wall panel, opposed front and rear wall panels, end wall panels, and a top closure panel, each said end wall panel being defined by a pair of folded overlapped flaps on ends of said front and rear wall panels and a flap on said bottom wall panel folded onto said overlapped flaps; said carton comprising: closure flaps on the opposed edges of said top closure panel which are disposed toward said end wall panels, said closure flaps extending downwardly over a portion of corresponding ones of said folded flaps on said front, rear, and bottom wall panels, and terminating at free edges of said closure flaps; closure flap extensions abutting said free edges of said closure flaps and extending downwardly over additional portions of said folded flaps; and means affixing each said closure flap extension on the corresponding one of said end wall panels, to those of said additional portions which lie immediately adjacent said closure flap extensions.

2. A fully assembled carton as in claim 1, and including a line of weakness on each said closure flap extending from said free edge to the one edge of said closure flap which is closest to said rear wall panel; the combination of said line of weakness, said free edge, and said one edge of said closure flap comprising a flap section; and means affixing said flap section to an underlying portion of said folded flap on said rear wall panel, said line of weakness being capable of tearing to release said top closure panel upon hinged pivotation of said top closure panel to open position.

3. A fully assembled carton according to claim 2 wherein said flaps on said bottom wall panel include regions that are so relieved that said closure flap extensions directly overlie both said bottom wall panel flaps and said front and rear wall panel flaps.

4. A fully assembled carton according to claim 3 wherein said bottom wall end flaps are of generally rectangular configuration, and wherein said relieved portions are defined by notches provided in the corners of the free edge portions of said bottom wall end flaps.

5. A fully assembled, unopened, carton of the type provided with a bottom wall panel, opposed front and rear wall panels, end wall panels, and a top closure panel, each said end wall panel being defined by at least one end flap extending from one of said bottom, front and rear wall panels; said carton comprising: closure flaps on the opposed edges of said top closure panel which are disposed toward said end wall panels, said closure flaps extending downwardly over a portion of said end flaps and terminating at free edges of said closure flaps; closure flap extensions abutting the free edges of said closure flaps and extending downwardly over additional portions of said end flaps; and means affixing each said closure flap extension, on the corresponding one of said end wall panels, to those of said additional portions which lie immediately adjacent said closure flap extensions.

6. A carton as in claim 5, and including a line of weakness on each said closure flap extending from said free edge to the one edge of said closure flap which is closest to said rear wall panel; the combination of said line of weakness, said free edge, and said one edge of said closure flap comprising a flap section; said flap section being affixed to an underlying portion of said end wall panel.

7. A carton as in claim 5 wherein each said end wall panel comprises a plurality of flaps depending from at least two of said rear, front and bottom wall panels, and wherein at least one of said closure flap and said closure flap extension overlies each flap of said plurality of flaps.

* * * * *